US011332956B2

(12) United States Patent
Murphy

(10) Patent No.: US 11,332,956 B2
(45) Date of Patent: May 17, 2022

(54) EMBELLISHMENT ATTACHMENT FOR A DOOR LOCK

(71) Applicant: Schlage Lock Company LLC, Carmel, IN (US)

(72) Inventor: Nathanael S. Murphy, Colorado Springs, CO (US)

(73) Assignee: Schlage Lock Company LLC, Carmel, IN (US)

( * ) Notice: Subject to any disclaimer, the term of this patent is extended or adjusted under 35 U.S.C. 154(b) by 522 days.

(21) Appl. No.: 15/466,343

(22) Filed: Mar. 22, 2017

(65) Prior Publication Data

US 2017/0275915 A1 Sep. 28, 2017

Related U.S. Application Data

(60) Provisional application No. 62/312,008, filed on Mar. 23, 2016.

(51) Int. Cl.

| | |
|---|---|
| ***E05B 15/02*** | (2006.01) |
| ***E05B 55/00*** | (2006.01) |
| ***E05B 9/08*** | (2006.01) |

(52) U.S. Cl.

CPC ..... *E05B 15/02* (2013.01); *E05B 55/005* (2013.01); *E05B 9/082* (2013.01); *Y10S 292/53* (2013.01); *Y10T 292/1014* (2015.04); *Y10T 292/57* (2015.04); *Y10T 292/59* (2015.04); *Y10T 292/82* (2015.04); *Y10T 292/85* (2015.04);

(Continued)

(58) Field of Classification Search

CPC ... Y10T 292/82; Y10T 292/85; Y10T 292/93; Y10T 292/869; Y10T 292/91; Y10T 292/57; Y10T 292/911; Y10T 292/59; Y10T 292/1014; Y10S 292/53; E05B 15/02; E05B 55/05; E05B 9/082; E05B 55/005

USPC ..... 292/347, 348, 358, 353, 357, 336.3, 292/DIG. 53; 70/224, 450–452

See application file for complete search history.

(56) References Cited

U.S. PATENT DOCUMENTS 2,423,206 A * 7/1947 Schlage ..... E05B 15/02 292/357
2,553,639 A * 5/1951 Dey ..... E05B 15/02 292/357

(Continued)

*Primary Examiner* — Christine M Mills
*Assistant Examiner* — Faria F Ahmad
(74) *Attorney, Agent, or Firm* — Taft Stettinius & Hollister LLP

(57) ABSTRACT

A rose assembly for a door lock and a method of removably securing the rose assembly to a lock chassis. The rose assembly is secured to the lock chassis through the use of an intermediate spring steel attaching plate, which provides both a secure attachment to the lock and orientation of the rose assembly to the lock housing. A single spring plate with integrated retention clip features provides a removably attachable interface between the rose and the lock chassis. The spring plate includes a hook feature to provide positive retention of the rose that is independent of the spring clip features. Additionally, the spring clips are located to minimize the possibility that one clip deflects substantially more than another. The installation process includes inserting the hook feature into a slot in the chassis housing, and then snapping the clip features over the housing to seat and retain the rose.

23 Claims, 10 Drawing Sheets

(52) U.S. Cl.
CPC ..... *Y10T 292/869* (2015.04); *Y10T 292/91* (2015.04); *Y10T 292/93* (2015.04)

(56) References Cited

U.S. PATENT DOCUMENTS 3,211,487 A * 10/1965 Maursey ..... G05G 1/12 292/353
4,037,865 A * 7/1977 Hook ..... E05B 3/06 292/357
4,998,760 A * 3/1991 Nixon ..... E05B 3/065 292/336.3
5,562,317 A * 10/1996 Kuo ..... E05B 3/06 292/359
5,590,555 A * 1/1997 Kester ..... E05B 17/2084 292/336.3
5,617,749 A * 4/1997 Park ..... E05B 3/065 292/336.3
5,666,833 A * 9/1997 Gao ..... E05B 3/065 292/336.3
5,718,468 A * 2/1998 Qureshi ..... E05B 63/0056 292/347
5,727,406 A * 3/1998 Banducci ..... E05B 3/065 70/224
5,727,824 A * 3/1998 Smith ..... E05B 3/065 292/169.21
5,732,578 A * 3/1998 Kang ..... E05B 3/065 292/336.3
5,784,909 A * 7/1998 Huang ..... E05B 55/005 292/336.3
5,992,189 A * 11/1999 McCaa ..... E05B 13/101 292/336.3
6,264,255 B1 * 7/2001 Fortune ..... E05B 3/00 292/336.3
6,616,203 B1 * 9/2003 Lenk ..... E05B 3/06 292/336.3
7,137,657 B2 * 11/2006 Wu ..... E05B 15/02 292/357
7,311,342 B1 * 12/2007 Fan ..... E05B 15/02 292/336.3
8,087,272 B1 * 1/2012 Korban ..... E05B 13/108 292/337
8,746,760 B2 * 6/2014 Chen ..... E05B 3/065 292/357
8,960,740 B2 2/2015 Huang et al.
9,447,610 B2 * 9/2016 Ou ..... E05B 63/006
10,844,633 B2 * 11/2020 Qiu ..... E05B 63/006
2002/0088084 A1 * 7/2002 Armstrong ..... E05B 3/003 16/82
2002/0096893 A1 * 7/2002 Wu ..... E05B 15/0053 292/347
2002/0117867 A1 * 8/2002 Bates ..... E05C 1/163 292/348
2002/0117868 A1 * 8/2002 Bates ..... E05B 55/005 292/358
2003/0155781 A1 * 8/2003 Bui ..... E05B 15/02 292/357
2004/0174020 A1 * 9/2004 Fishencord ..... E05B 55/005 292/169
2004/0201230 A1 * 10/2004 Wu ..... E05B 15/02 292/357
2006/0220397 A1 * 10/2006 Ellis ..... E05B 3/06 292/336.3
2008/0111384 A1 * 5/2008 Ellis ..... E05B 3/065 292/336.3
2009/0211318 A1 * 8/2009 Pilotelli ..... E05C 1/163 70/141
2012/0235429 A1 * 9/2012 Chen ..... E05B 3/065 292/357
2013/0276491 A1 10/2013 Huang et al.
2015/0240530 A1 * 8/2015 Mani ..... E05B 3/065 292/336.3

* cited by examiner

EMBELLISHMENT ATTACHMENT FOR A DOOR LOCK

CROSS-REFERENCE TO RELATED APPLICATIONS

The present application claims the benefit of U.S. Provisional Patent Application No. 62/312,008 filed Mar. 23, 2016, the contents of which are incorporated herein by reference in their entirety.

TECHNICAL FIELD

The present disclosure relates generally to devices having cover plates, and more particularly, but not exclusively, relates to lock devices having decorative cover plates.

BACKGROUND

Locksets for doors often include decorative trim components, which provide a level of visual and aesthetic appeal to a primarily functional product. One of the decorative components that can provide a significant enhancement to the overall appearance is the rose, which may also be referred to as the rosette or escutcheon. Such roses are typically offered in a broad range of configurations, ranging from relatively simple and inexpensive designs, such as those formed of stamped brass, to more solid and stylish designs, such as those formed of die-cast zinc or forged brass. Certain roses of the latter type are non-round in shape, and may have various ornate geometries. Due to their mass and shape, these types of roses may require secure attachment and positive orientation relative to the lock chassis.

In certain conventional locksets, the rose is permanently affixed to the lock chassis at the time of factory assembly, which may in turn result in one or more disadvantages. For example, such locksets typically require that the mounting screws be accessible through openings in the rose, which may be aesthetically unpleasing. Additionally, should the end user desire to update or upgrade the appearance of the lockset, the permanently-affixed rose cannot be removed and replaced with a rose of a different style.

Other conventional locksets attempt to address the above-noted drawbacks by providing a releasable coupling between the rose and the chassis. However, these attempts have limitations of their own. For example, in order for the lock mounting screws to be hidden or covered by a removable trim, the rose may need to be attached to the lock chassis at the time of installation rather than by a factory assembly process. The releasable coupling is typically provided by spring clips that are affixed to either the rose or the chassis during factory assembly, which may increase the cost of the lock by both the cost of the clips and the associated assembly cost.

In certain approaches, the two or more spring clips are attached to the lock chassis. The lock chassis may be configured for use with roses of varying configurations, where some of the configurations do not require engagement with the spring clips, and other configurations are structured to engage the spring clips. When such a lockset is sold with the former type of rose, the unused spring clips may unnecessarily increase the cost of the lockset. For example, if the lockset is shipped with a cheap stamped brass rose that does not utilize the spring steel clips for attachment, the additional cost of the unused spring clips may be undesirable. Additionally, the latter type of rose may require undercut features to snap into engagement with the spring clips. Such undercut features may be undesirable, particularly when the rose is die-cast or forged. For example, such undercut features may require a more complex casting mold and/or a secondary operation, each of which may involve additional costs.

In other approaches, the spring clips are attached to the rose. In such approaches, the at least two clip components are factory assembled to the rose and fastened by some means, such as a screw or rivet. The resulting position and orientation of the two clips relative to each other may be less than desirable, and is sensitive to manufacturing tolerances. In addition, the size of the rose may have to be increased in order to accommodate the fasteners that secure the clips to the rose. In some cases, the clip design may need to be customized based on the shape, size, and/or geometry of the rose. There is also the potential that one of the spring steel clips may become overstressed during installation. Additionally, because the clips are provided as separate components, installation of the rose can be biased more toward one clip than the other, potentially resulting in permanent deformation of one clip. When this happens, the retention effectiveness of the clips is reduced, and the rose may not be secured tightly to the lock chassis.

As should be evident from the foregoing, certain drawbacks and limitations are associated with certain current techniques for attaching a rose to a chassis assembly, whether permanently or releasably. For these reasons among others, there remains a need for further improvements in this technological field.

SUMMARY

The present application is directed to a rose assembly and method for attaching a cover plate, such as a rose assembly, to a mounting assembly, such as a lock chassis. The rose assembly and method of attachment may provide a secure attachment of the rose, and accurate orientation relative to the lock chassis. The rose assembly may provide for simple installation and removal, while ensuring that the fit to the lock chassis is not compromised by the installation process or is overly sensitive to manufacturing tolerances.

In one aspect of the present application, there is provided a door lock including a lock chassis having a housing with a locating feature and a retaining feature. The door lock further includes a rose assembly configured to be releasably coupled to the housing. The rose assembly includes a rose and a plate permanently secured to the rose, wherein the plate includes a tab configured to engage the locating feature and a resilient member configured to engage the retaining feature.

In another aspect of the present application, there is provided a rose assembly for a door lock having a housing configured to receive the rose. The rose assembly includes a rose; and a plate securely affixed to the rose. The plate includes a tab configured to engage the housing at a first location and a resilient member configured to engage the housing at a second location, wherein relative lateral movement of the plate with the housing aligns the rose assembly with the housing and closing movement of the plate with the housing deflects the resilient member to a position with respect to the housing to resiliently secure the rose to the housing.

In a further aspect of the present application, there is provided a method of assembling a rose assembly for a door lock having a housing with a locating feature. The method includes providing a rose including an alignment feature and a centering portion, providing a plate including a tab and a resilient member, each configured to engage the housing, and a seating surface configured to engage the alignment feature and the centering portion, aligning the seating surface with the alignment feature and with the centering portion, moving the plate into contact with centering portion, and securely attaching the plate to the seating surface to provide a unitary rose assembly.

DETAILED DESCRIPTION OF ILLUSTRATIVE EMBODIMENTS

Figure 1:
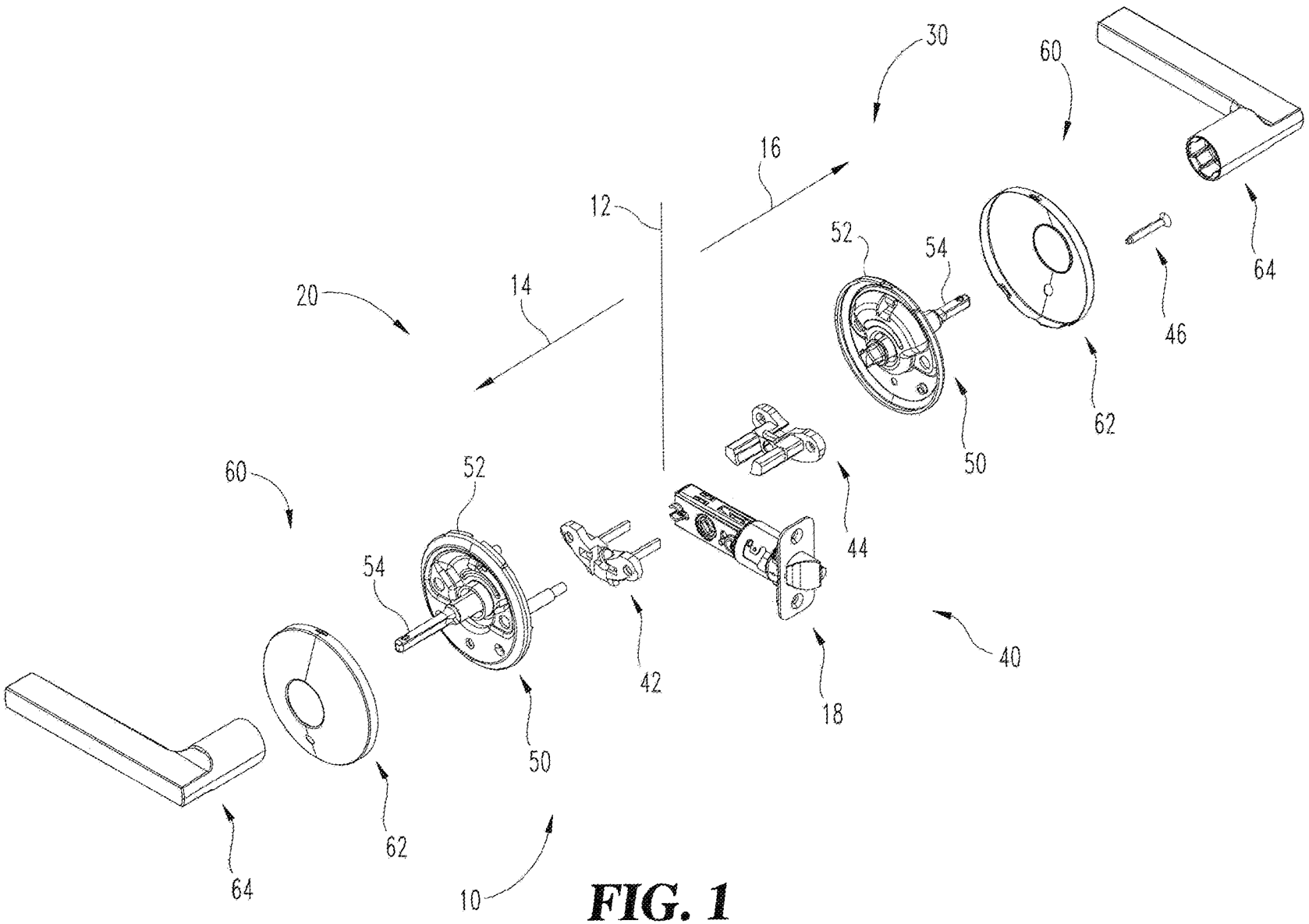
FIG. 1 is an exploded perspective view of a tubular lock.

For the purposes of promoting an understanding of the principles of the invention, reference will now be made to the embodiments illustrated in the drawings where specific language is used to describe the same. It should be understood that no limitation of the scope of the invention is thereby intended. Any alterations and further modifications in the described embodiments, and any further applications of the principles of the invention as described herein are contemplated as would normally occur to one skilled in the art to which the invention relates.

FIG. 1 illustrates a tubular lock assembly 10 according to one embodiment of the present disclosure. As shown in FIG. 1, a line 12 distinguishes between exterior and interior portions of the lock assembly 10. When installed in a door, the lock assembly 10 extends toward an exterior side of the door in the direction of a line 14, and extends toward an interior side of the door, adjacent to a room interior for instance, in the direction of a line 16. While the lock assembly 10 illustrated in FIG. 1 is provided in the form of a tubular lockset, it is to be appreciated that the attachment features described herein may be utilized in connection with other forms of locksets, or with assemblies other than locksets.

The lock assembly 10 includes a latch 18, an outside assembly 20, an inside assembly 30, and a locking mechanism 40 including an outside locking module 42, an inside locking module 44, and a locking mechanism actuator 46. Additionally, the outside assembly 20 includes the outside locking module 42, and the inside assembly 30 includes the inside locking module 44 and the actuator 46. In one embodiment, the actuator 46 provides a push button user interface for adjusting the locking mechanism 40, and thus the assembly 10, between locked and unlocked states. The actuator 46 is typically accessible from the interior side of a door to enable a user to lock the door from inside a room in order to prevent others from entering the room. In the illustrated form, the locking modules 42 and 44 are designed as self-contained modular subassemblies. In other embodiments, one or both of the locking modules 42, 44 may be integral to the corresponding one of the outside and inside assemblies 20 and 30.

Each of the outside assembly 20 and the inside assembly 30 includes a chassis subassembly 50 and decorative trim components 60. Each chassis subassembly 50 includes a housing 52 and a spindle 54 that is rotatably mounted to the housing 52. The trim components 60, which may alternatively be referred to as embellishment attachments, include a rose 62 and a handle 64, which are respectively mounted to the housing 52 and spindle 54 of the corresponding chassis subassembly 50. In the illustrated form, each rose 62 is circular, and each handle 64 is provided as a lever-type handle. As described in further detail below, it is also contemplated that one or both of the roses 62 may be non-circular, and that one or both of the handles 64 may be provided as another type of handle, such as a knob-type handle.

Figure 2:
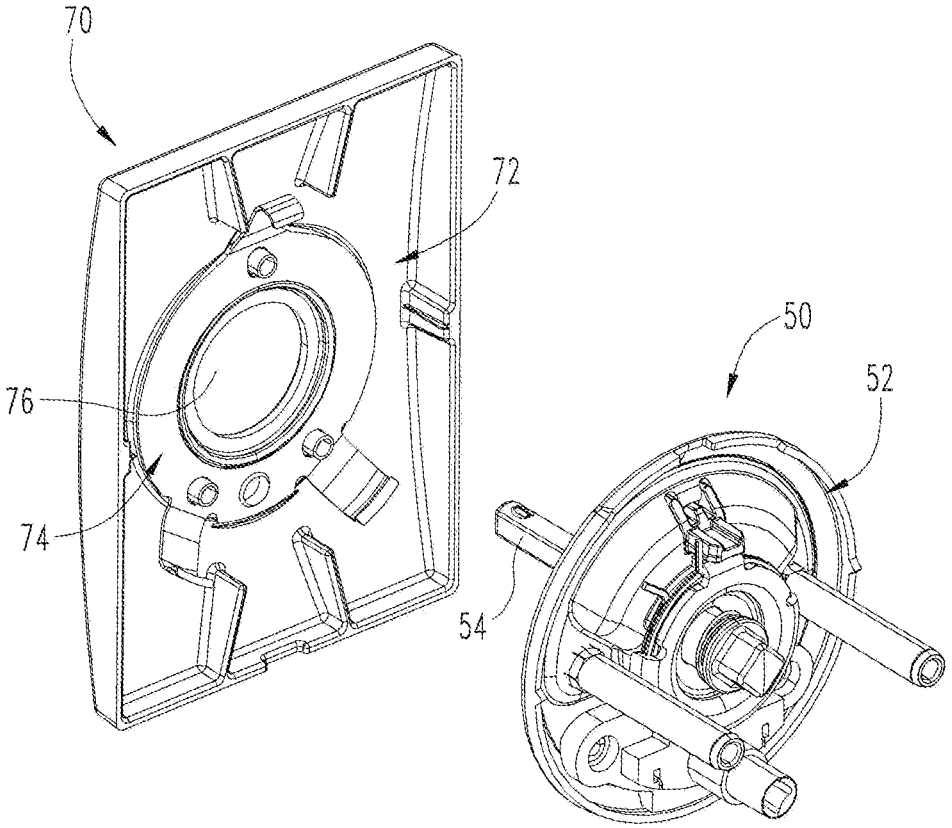
FIG. 2 is an exploded perspective view of a rose assembly, including a rose and a plate, and a lock chassis.

FIG. 2 illustrates an exploded perspective view of a rose assembly 70 according to one embodiment, which is configured to interface with the chassis subassembly 50. The rose assembly 70 includes a rose 72, which may be utilized as the rose 62, and a plate 74 mounted to the rose 72. In one embodiment, the plate 74 is a spring plate including features configured to reasonably secure the rose assembly 70 to the lock chassis 50, while enabling the replacement of the rose assembly 70 if desired. The rose 72 defines a hole 76, which may be centrally located on the rose 72 in certain embodiments. The spindle 54 extends through the hole 76, and the corresponding handle 64 is coupled to the shaft 54 to move the latch 18.

Figure 3:
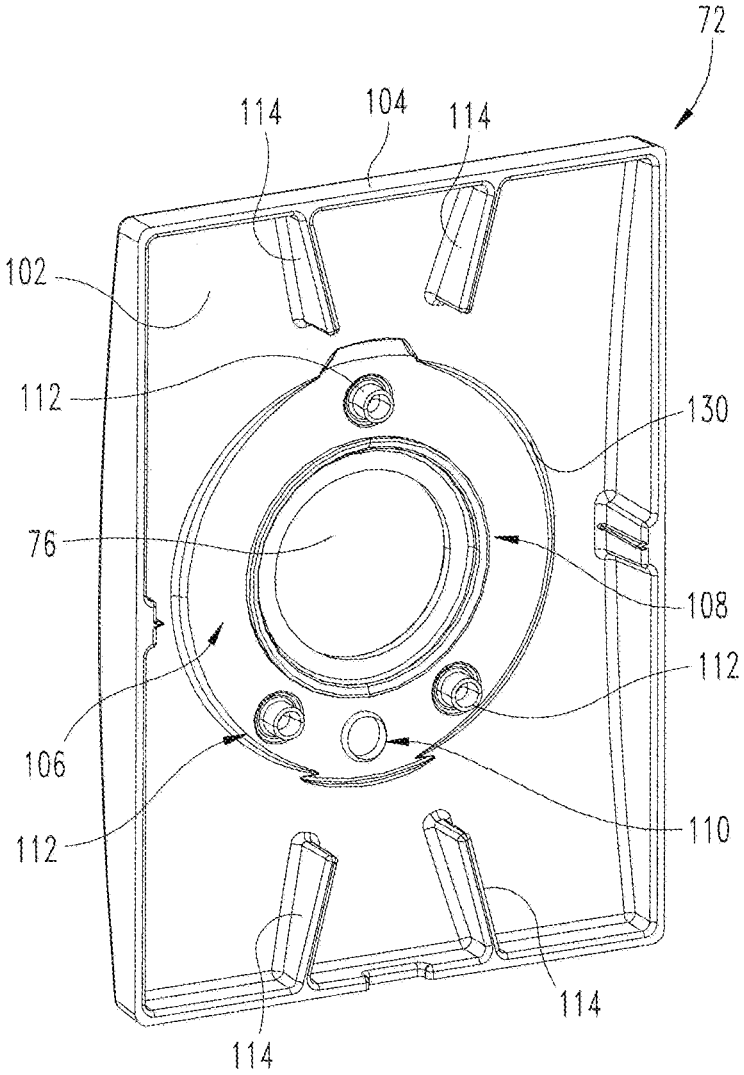
FIG. 3 is a rear perspective view of a rose.

FIG. 3 illustrates a rear perspective view of the rose 72. The rose 72 includes a base portion 102 including an outer perimeter defined by a collar 104. The collar 104 extends from the base portion 102 to define an upstanding sidewall configured to surround a portion of the lock chassis 50. The base portion 102 includes a seating surface 106 which includes, in one embodiment, a generally circular recess formed in the base portion 102. The seating surface 106 is generally flat. While the collar 104 generally defines a generally rectangular outer perimeter, other embodiments include outer perimeters defining other shapes including generally circular, generally oval, and others.

A centering ring 108 is located adjacent to and extends away from the seating surface 106 to provide a locating feature for the plate 74. The centering ring 108 is generally circular and surrounds the hole 76. In one embodiment, the centering ring 108 is continuous about the hole 76. In other embodiments, the centering ring 108 is not continuous, but is discontinuous and includes spaced segments or other spaced features such as posts. An alignment boss 110 is located at the seating surface 106 and extends therefrom to provide a locating feature for the plate 74. The alignment boss 110 provides for proper alignment of the plate 74 with respect to the rose 72. One or more staking bosses 112 may also be located at the seating surface 106. In the illustrated embodiment, a total of three staking bosses 112 are utilized, and the rose 72 includes one or more ribs 114, each of which extends along an interior surface of the rose 72 toward the hole 76. In the illustrated embodiment, the ribs 114 are coupled to the collar 104 to interface with and coaxially locate with the housing 80. The ribs may also provide support for the collar 104.

Figure 4:
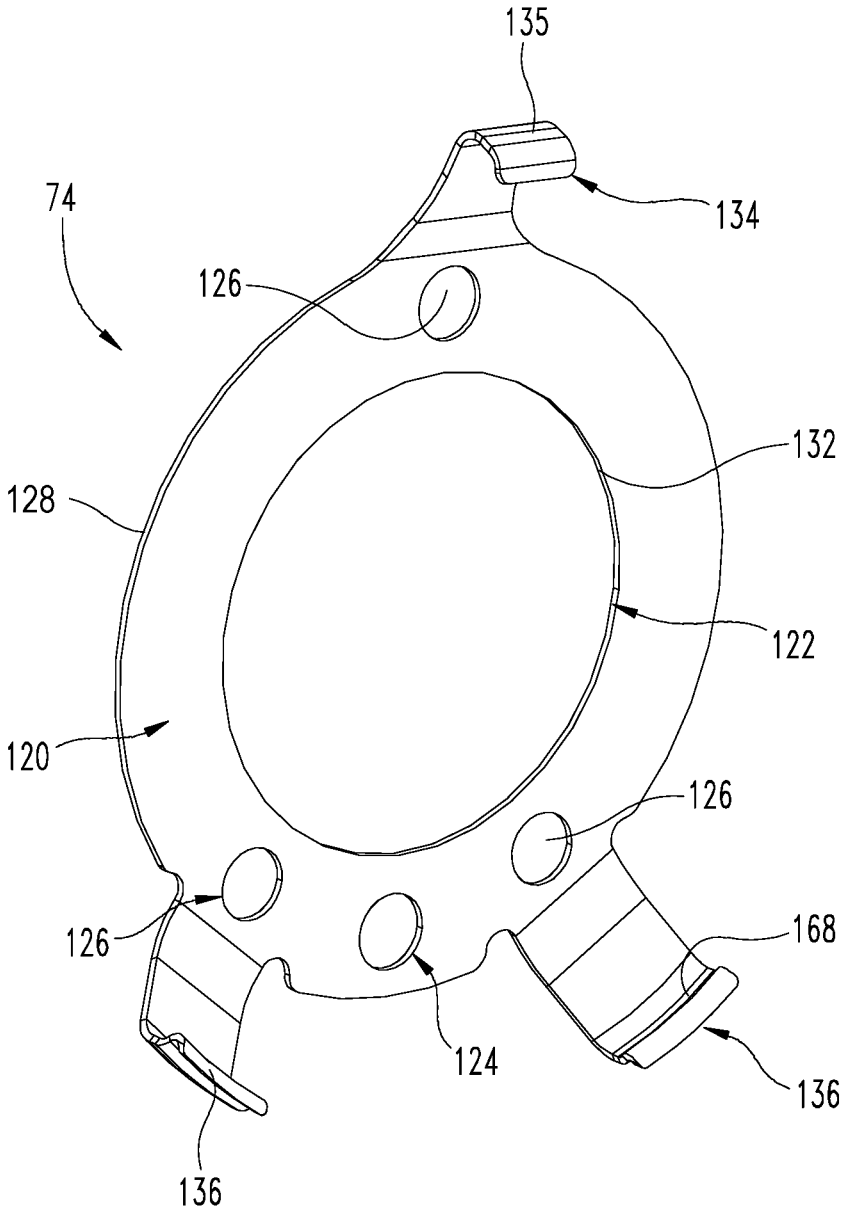
FIG. 4 is a perspective view of a plate.

FIG. 4 illustrates a perspective view of the plate 74. In the illustrated embodiment, the plate 74 is a spring plate made of a resilient metal such as a spring steel material. In another embodiment, the plate is made of an elastomer material. Other materials having sufficient resilient properties are possible as well. The plate 74 includes a ring-shaped annular portion having a substantially flat seating surface 120, a centering hole 122, a rotational alignment hole 124, and one or more receiver holes 126. The ring-shaped annular portion of the plate 74 defines an outside perimeter edge 128, which is generally configured to align with an outside perimeter 130 of the seating surface 106 (FIG. 3). The centering hole 122 defines an inside perimeter edge 132 which is generally configured to align with the centering ring 108. In another embodiment, the alignment boss 110 and the alignment hole 124 may be omitted. One or more the staking bosses 112 and an associated receiver hole 126 may be used to provide for alignment of the plate 74 with the rose 72.

The plate 74 also includes a locating leg 134. In one embodiment the locating leg 134 includes a hooked end 135. The locating leg 134 is inclined with and extends from the surface 120. The plate 74 further includes one or more resilient legs 136, each of which extends from the surface 120 and is configured to act as a clip. In the illustrated embodiment, the plate 74 includes two of the resilient legs 136. In certain embodiments, additional resilient legs may be included in order to increase retention capacity to thereby hold the plate 74, and therefore the rose assembly 70, more securely to the chassis 50.

Figure 5:
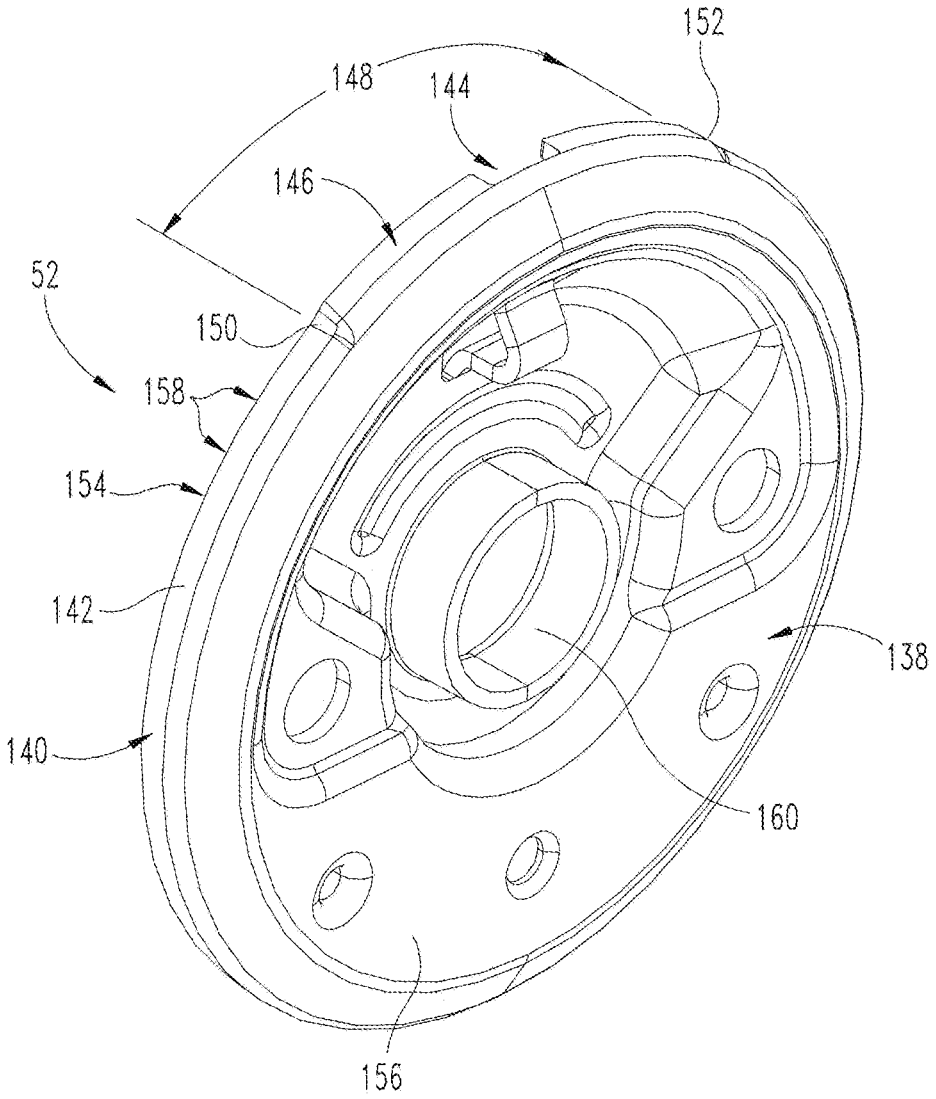
FIG. 5 is a perspective view of a chassis housing.

FIG. 5 illustrates a front perspective view of the chassis housing 52. The chassis housing 52 includes a chassis base 138 including a chassis collar 140, which defines an outside perimeter of the chassis base 138. The chassis collar 140 includes a wall having a substantially cylindrical outside surface 142, which defines an orienting and retaining slot 144. The outside surface includes a first portion 148 defined between a first step 150 and a second step 152. The first portion 148 includes an angular span of approximately fifty degrees (50°) from the first step 150, along the retaining slot 144, and to the second step 152. A second portion 154 extends from the first step 150 to the second step 152 around the remaining perimeter, but not through the slot 144. The second portion 154 extends the remaining approximately three hundred and ten degrees (310°) of the housing circumference. The surface of the first portion 148 extends substantially perpendicular to a plane defined by a front surface 156. The surface of the second portion 154 defines a reverse tapered portion in this embodiment. The reverse tapered portion is inclined with respect to the surface 156 of the first portion 148, such that an edge 158 extends inwardly toward a center hole 160. In one embodiment, the inward edge 158 extends entirely around the second portion 154. In other embodiments, the inward edge 158 is located at predefined location to accept legs 136. The retaining slot 144 is substantially centered within the span of the outside cylindrical surface 142, such that when the housing 52 is positioned with the chassis 50, the retaining slot 144 is at the top of chassis 50. In other embodiments, the retaining slot 144 may be positioned at other locations of the surface 142.

Figure 6:
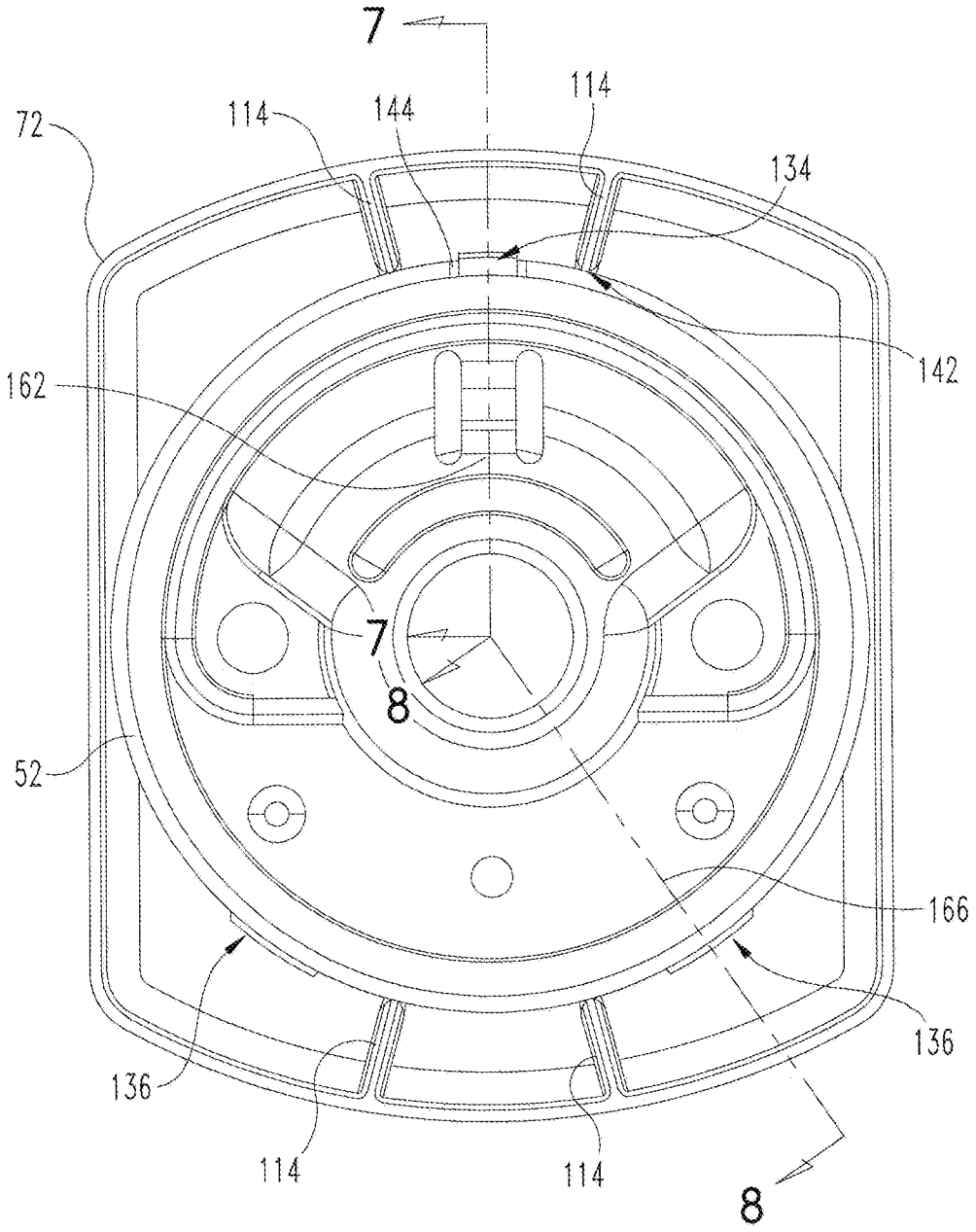
FIG. 6 is a rear elevational view a rose, spring plate, and a housing, in a fully interfaced position.

FIG. 6 illustrates a rear elevational view of the rose 72, the plate 74, and the housing 52 in a fully interfaced position. The locating leg 134 is inserted into slot 144. In the illustrated embodiment, the hooked end 135 is located above and extends over and past the surface defining the slot 144. This engagement of the locating leg 134 with the slot 144 provides both a rotational orientation and positive axial retention of the housing 52 to the plate 74. Each of the resilient legs 136 is snapped over and engaged with the second portion 154. The ribs 114 of the rose 72 are adjacent the cylindrical surface 142, and provide accurate radial location of the rose assembly 70 to the housing 52.

Figure 7:
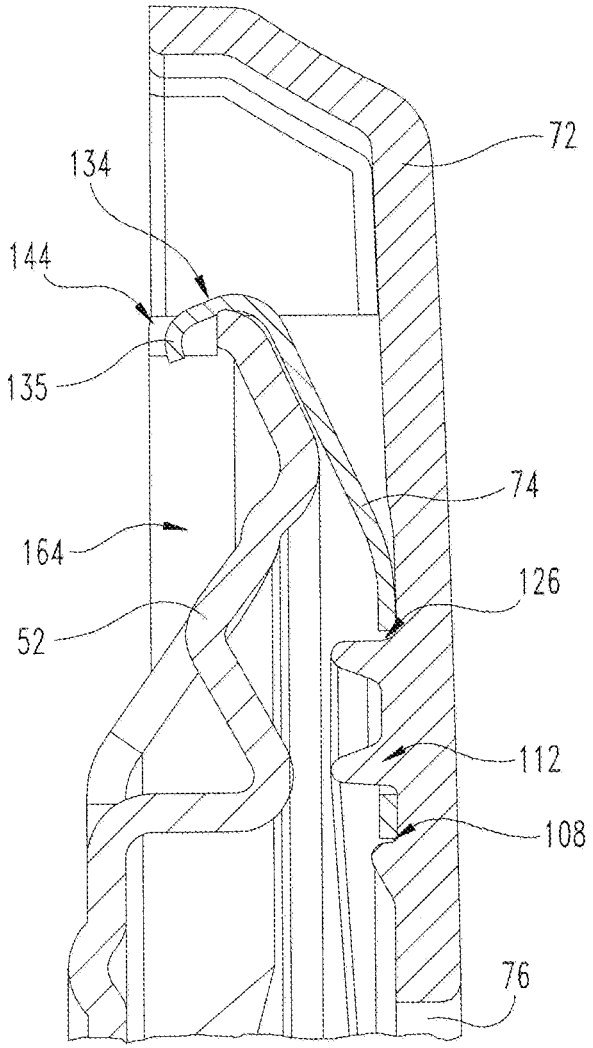
FIG. 7 is a side sectional view of a rose, a plate, and a housing, as sectioned through a spring plate hook feature.

FIG. 7 illustrates a side sectional view of the rose 72, the plate 74, and the housing 52 sectioned through the locating leg 134 and along the line 162 illustrated in FIG. 6. The locating leg 134 is captured within the slot 144, and the hooked end 135 extends over the housing 52 and into an interior 164 of the housing 52. The centering ring 108 surrounds the centering hole 76, which ensures the plate 74 is assembled coaxially with the rose 72. The receiver hole 126 surrounds the staking boss 112. When the staking boss 112 is rolled over or deformed with respect to the plate 74, the staking boss 112 captures and mates the plate 74 securely or relatively permanently to the rose 72. Thus, the staking boss 112 acts as a rivet to secure the plate 74 to the rose 72. In another embodiment, the plate 74 is removably attached to the rose 72 with removable types of fasteners, such as screws.

Figure 8:
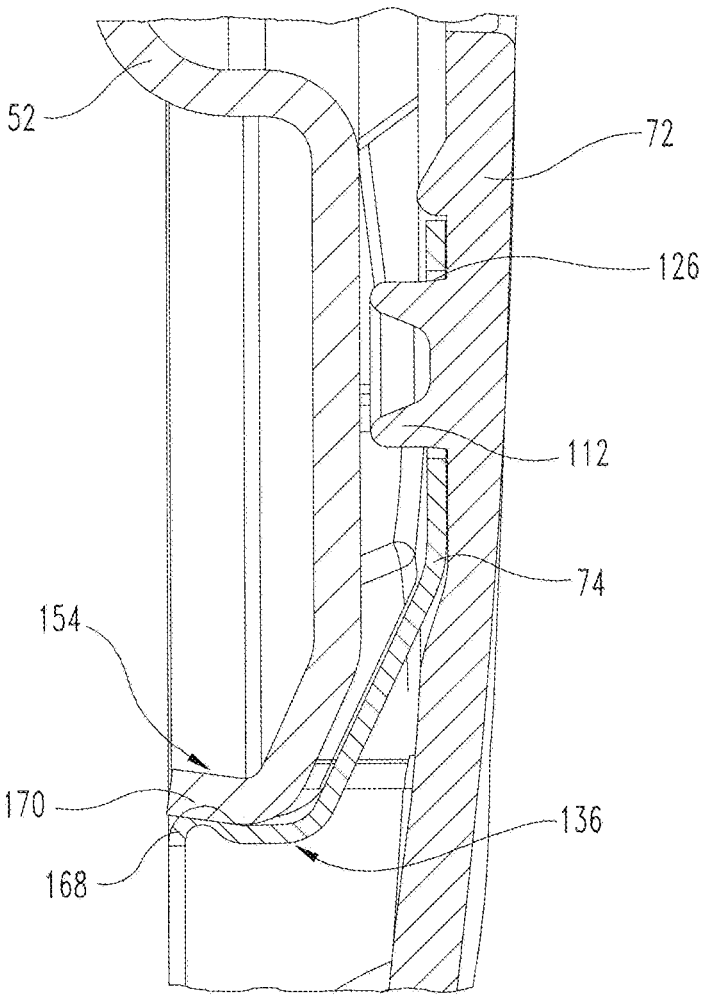
FIG. 8 is a side sectional view of a rose, a plate, and a housing, as sectioned through a spring plate and a spring clip leg.

FIG. 8 illustrates a side sectional view of the rose 72, the plate 74, and housing 52, sectioned through the plate 74 and a resilient clip leg 136 along the line 166 illustrated in FIG. 6. The clip leg 136 engages the reverse taper portion of the second portion 154 of the housing 78. This interface is designed such that the clip leg 136 is deflected when the rose assembly 70 is moved to the installed position in order to maintain an interface pressure and a tight fit of the spring plate 74 to the housing 52. As illustrated in FIG. 4, the clip leg 136 includes a ridge 168 extending along a width thereof. In other embodiments, the ridge 168 does not extend along the entire width of the clip leg 136. In still other embodiments, the ridge is discontinuous or is located at a single point on the clip leg 136. The ridge 168 is configured to engage a retaining feature 170, such as a recess, defined in the reverse taper portion of the second portion 154. In certain embodiments, the recess 170 extends along the entire length of the second portion 154. In other embodiments, the recess 170 is located only at a predetermined location positioned to receive an appropriately located clip leg 136. In still other embodiments, the retaining feature 170 includes a ridge over which the ridge 168 moves across during assembly.

As described herein, the plate 74 is substantially flat and thin. Since the plate is secured to the rose 72 by the rivet-like rose bosses 112, the depth of the rose 72 may be relatively small. Additionally, the alignment, locating, and securing features of the spring plate 74 are included in a single component, which may enable better manufacturing control of these related features. The hook shaped locating leg 134 provides for accurate alignment between the rose 72 and the housing 54, and may also provide positive retention of the rose 72 that is independent of the retention capability of the spring clip legs 136. The locating leg 134 may additionally reduce the amount of retention force needed from the spring clip legs 136.

Figure 9:
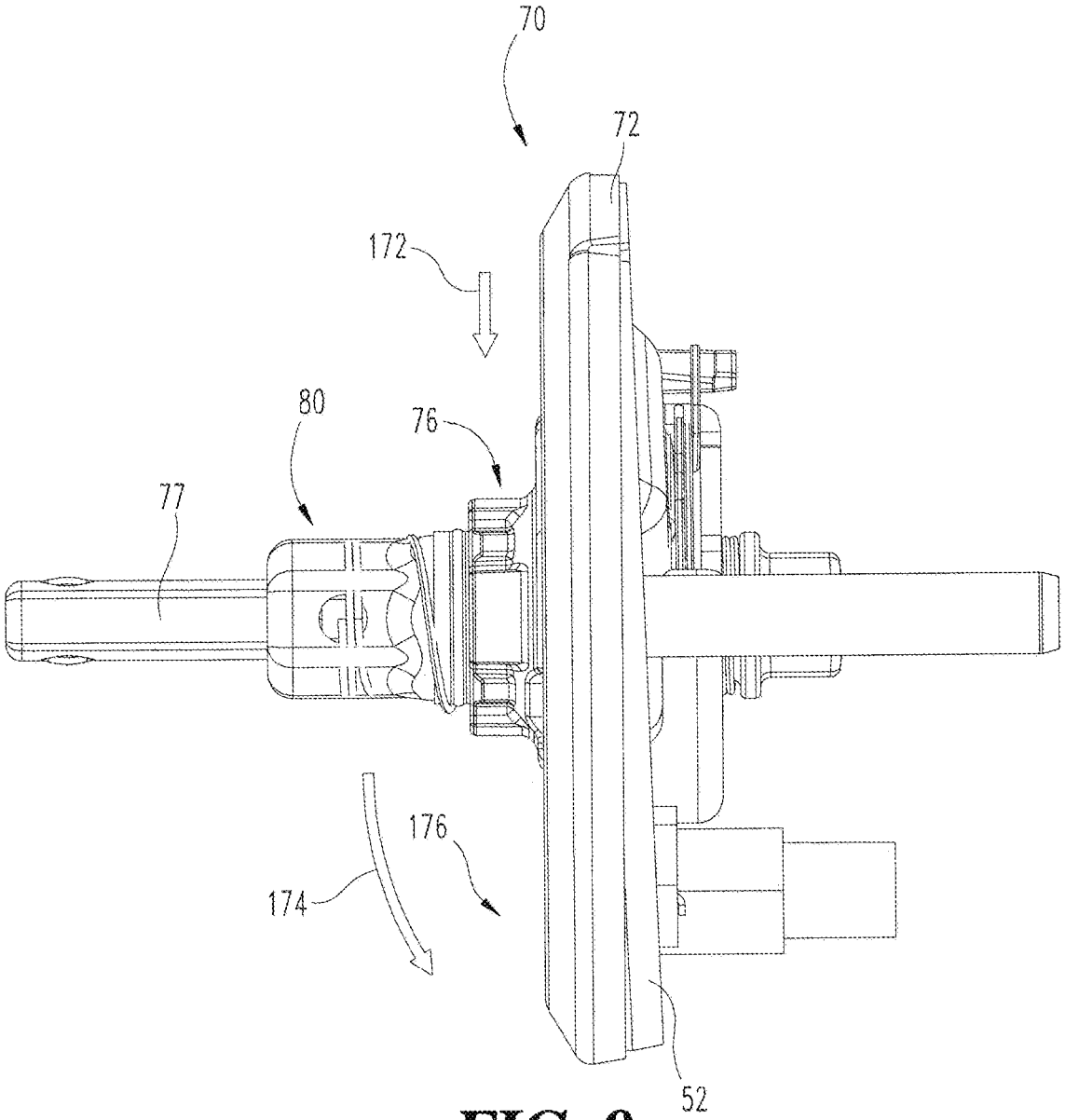
FIG. 9 is a side elevational view of a rose assembly and a housing illustrating an installation process for a rose assembly to the housing.

FIG. 9 illustrates a side elevational view of the rose assembly 70 and the chassis 50, and further illustrates an installation process for installing the rose assembly 70 to the housing 52. Initially, the center hole 76 of the rose 72 is aligned with the spindle 54 and the rose assembly 70 is moved toward the housing 52. Once the rose assembly 70 is located adjacently to the housing 52, two steps are used to ensure that the rose assembly 70 is mated to the housing 52. In a first step, the leg 134 is aligned with the slot 144 and a slight downward motion of the rose assembly 70 is made in order to engage the leg 134 into the housing slot 144. This motion is generally made in a direction 172. In a second step, an inward swing or rotational motion of the rose assembly 70 is made towards the housing 52 with sufficient pressures to overcome the constraint of the clip 136 as it engages the housing 52. This motion is generally made in a direction 174. By applying sufficient pressure to the outer surface of the rose 72, generally toward a bottom portion 176, the clip legs 136 are forced to snap over the outer diameter of the housing 52 to engage with the reverse taper portion of the second portion 154. Once snapped in place, the rose assembly 70 is properly located with respect to the housing 52.

In the event that removal of the rose assembly 70 from the housing 52 is desired, the process of removal generally follows the installation process in reverse. The bottom portion 176 is pulled away from the housing 52 in a direction opposite the direction 174. Once the clip legs 136 are disengaged from the housing 52, the rose assembly 70 is moved in an upward direction opposite the direction 172. Due to the fact that the spring clip legs 136 are not diametrically opposite one another, the risk of overstressing one or both of the legs 136 is significantly diminished. Instead, as the rose assembly 70 is attached to the chassis 50, both of the spring clip legs 136 should deflect and be stressed relatively uniformly. In FIG. 9, the rose 72 is shown to be at an angle with respect to the housing 52, just prior to finalizing the attachment of the rose assembly 70 to the housing 52.

Figure 10:
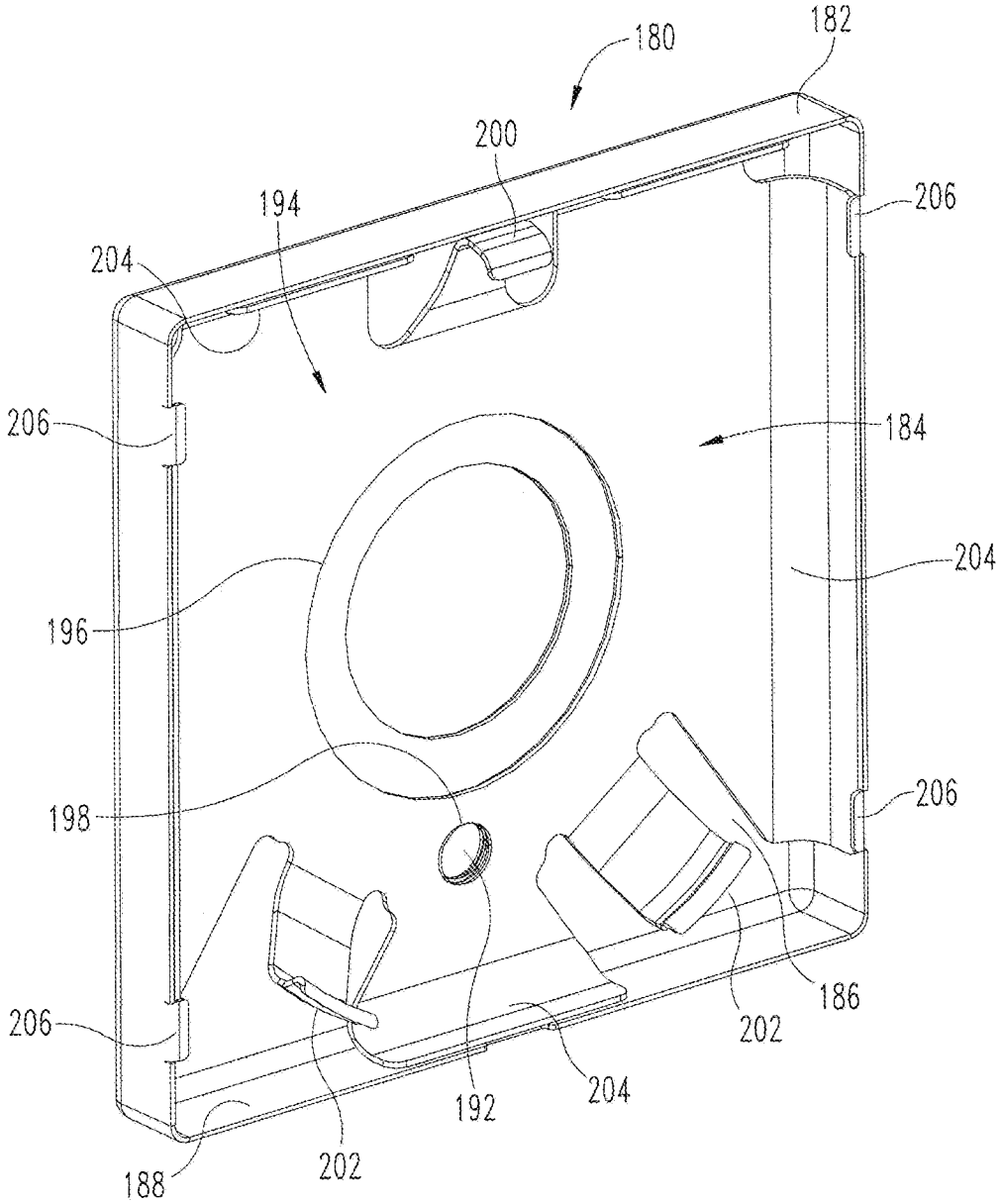
FIG. 10 is a perspective view of another embodiment of a rose.

FIG. 10 illustrates a perspective view of another embodiment of a rose assembly 180, which may be utilized in a manner similar to that described above with reference to the rose assembly 70. In this embodiment, the rose assembly 180 includes a rose 182 and a plate 184. The rose 182 includes a generally rectangular shape and a base portion 186 having a collar 188 extending from the base portion 186 and around a perimeter thereof. The base portion 186 includes an interior surface, which is generally planar and defines a center hole 190. An actuator hole 192 is also included in the event that the lock includes an actuator. In other embodiments, an actuator hole 192 is not included.

The base portion 186 and the collar 188 define an interior cavity 194 which is configured to receive the plate 184. In this embodiment, the interior surface of the base portion 186 which receives the plate 184 does not include any engagement features other than the holes 190 and 192. In this respect, this embodiment of the rose 182 provides a more straightforward design and manufacture when compared to the rose 72. The plate 184 includes a first hole 196 and a second hole 198 which are located to align with the holes 190 and 192. The plate 184 includes a locating leg 200 and one or more resilient legs 202. In this embodiment, therefore, the same attachment features as described above are maintained in the plate 184, while the remainder of the plate 184 is designed to conform to the interior cavity 194 of the rose 182.

In this embodiment, the rose 184 includes a plurality of upstanding sidewalls 204. When the plate 184 is located in the cavity 194, the upstanding sidewalls 204 are located adjacently to the collar 188. The collar 188 includes a plurality of tabs 206, which are bent toward the hole 190 to capture a top edge of the sidewalls 204. Once the tabs are bent over, the plate 184 is attached to the rose 182 to form the rose assembly 180.

In one embodiment, the rose 182 is stamped metal. In another embodiment, the rose 182 is formed of a plastic material and the plate 184 is fixed to the rose 182 with an adhesive or other securing means. In another embodiment, the tabs 206 are replaced with clips. The described plate 184 of this embodiment may be utilized with housings of various configurations, as the overall geometry of the plate 184 can be adapted to closely follow the shape of the housing. This ensures that it is compatible with many different external rose shapes and geometries.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected.

It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A door lock, comprising:

a lock chassis including a housing having an outer perimeter; and a rose assembly releasably coupled to the housing, the rose assembly including a rose and a plate positioned within the rose and secured to the rose, wherein the plate includes a tab and a plurality of resilient members, wherein the tab is engaged in contacting abutment with the outer perimeter of the lock chassis housing, and wherein each of the resilient members includes an end portion that snaps over and is engaged in contacting abutment with the outer perimeter of the lock chassis housing to resiliently secure the plate and the rose to the lock chassis housing.

2. A door lock, comprising:

a lock chassis including a housing having an outer perimeter; and a rose assembly releasably coupled to the housing, the rose assembly including a rose and a plate positioned within the rose and secured to the rose, wherein the plate includes a tab and a plurality of resilient members, wherein the tab is engaged in contacting abutment with the outer perimeter of the lock chassis housing, and wherein each resilient member includes a first portion extending from the plate and a second portion that is inclined with respect to the first portion and is engaged with the outer perimeter of the lock chassis housing.

3. The door lock of claim 2, wherein the rose includes an alignment feature and a centering portion, and wherein the plate includes a seating surface engaged with the alignment feature and the centering portion.

4. The door lock of claim 1, wherein the rose includes an alignment feature and a centering portion, and wherein the plate includes a seating surface engaged with the alignment feature and the centering portion; and wherein engagement of the seating surface with the alignment feature and with the centering portion aligns the tab with the locating feature of the lock chassis.

5. The door lock of claim 3, wherein the alignment feature includes a boss extending from the centering portion, wherein the boss is engaged with the seating surface of the plate.

6. The door lock of claim 5, wherein the seating surface of the plate defines a generally planar surface engaged with the centering portion and an alignment hole through which the boss extends.

7. The door lock of claim 2, wherein the outer perimeter of the lock chassis housing includes a slot configured to engage an engagement surface of the tab.

8. The door lock of claim 1, wherein the lock chassis housing includes a generally planar surface and a corresponding inclined surface extending about the outer perimeter of the lock chassis housing that is inclined with respect to the planar surface, and wherein a face of each resilient member resiliently engages the inclined surface.

9. A rose assembly for a door lock having a housing configured to engage the rose, the rose assembly comprising:

a rose; and a plate positioned in the rose and securely affixed to the rose, wherein the plate includes a tab configured to engage the housing at a first location and a resilient member configured to engage the housing at a second location, wherein relative lateral movement of the plate with the housing aligns the rose assembly with the housing and closing movement of the plate with the housing deflects the resilient member to a position with respect to the housing to resiliently secure the rose to the housing;

wherein the plate further includes a ring-shaped annular portion having an inner perimeter and an outer perimeter, and wherein the tab and the resilient member extend radially outward from the outer perimeter of the annular portion.

10. The rose assembly of claim 9, wherein the rose includes an alignment feature and a centering portion, and the plate includes a seating surface configured to engage the alignment feature and the centering portion.

11. The rose assembly of claim 10, wherein the engagement of the seating surface with the alignment feature and with the centering portion aligns the engagement surface of the tab with the locating feature of the housing.

12. The rose assembly of claim 11, wherein the alignment feature includes a boss extending from the centering portion, wherein the boss is configured to engage the seating surface of the plate.

13. The rose assembly of claim 12, wherein the rose includes at least one rib extending from an outer portion of the rose and extending toward the centering portion of the rose.

14. The rose assembly of claim 12, wherein the seating surface of the plate defines a generally planar surface configured to engage the centering portion and an alignment hole configured to engage the boss.

15. An apparatus, comprising:

a housing having an outer perimeter, the outer perimeter including a plurality of recesses;

a spindle rotatably mounted to the housing; and a cover plate assembly comprising:

a cover plate including an opening, a positioning surface, a plurality of bosses, and a rim, wherein the spindle extends through the opening, wherein the positioning surface surrounds the opening, wherein the bosses extend from the positioning surface, and wherein the rim surrounds the outer perimeter of the housing; and a spring plate located inside the cover plate and secured to the cover plate, the spring plate including a ring-shaped annular portion having an inner perimeter and an outer perimeter, and a plurality of arms extending from the outer perimeter of the annular portion, wherein the annular portion is engaged with the positioning surface and surrounds the opening in the cover plate, wherein the annular portion includes a plurality of apertures through which the plurality of bosses extend, and wherein each of the arms extends from the outer perimeter of the annular portion and is engaged with a corresponding one of the recesses in the outer perimeter of the housing;

wherein the cover plate assembly is releasably attached to the housing as a result of the engagement between the arms and the recesses.

16. The apparatus of claim 15, wherein at least one of the bosses is deformed to form a riveted connection securing the spring plate to the cover plate.

17. The apparatus of claim 15, wherein the plurality of recesses comprises a locating slot and a first retaining recess including a first angled surface, wherein a first of the arms includes a tab received in the locating slot, and wherein a second of the arms is a first resilient arm that is resiliently engaged with the first retaining recess, the first resilient arm including a first angled section engaged with the first angled surface.

18. The apparatus of claim 16, wherein the plurality of recesses further comprises a second retaining recess including a second angled surface, wherein a third of the arms is a second resilient arm that is resiliently engaged with the second retaining recess, the second resilient arm including a second angled section engaged with the second angled surface, wherein the first resilient arm and the second resilient arm are equally spaced from the first arm.

19. The apparatus of claim 15, further comprising a latch, wherein the latch is engaged with the spindle and configured to extend and retract in response to rotation of the spindle, and wherein the cover plate is a rose.

20. A door lock, comprising:

a lock chassis including a housing having a locating feature and a plurality of retaining features; and a rose assembly releasably coupled to the housing, the rose assembly including a rose and a plate positioned within the rose and secured to the rose, wherein the plate includes a tab and a plurality of resilient members, wherein the tab is engaged with the locating feature, and wherein each of the resilient members is engaged with a corresponding one of the plurality of retaining features;

wherein the rose further comprises a boss extending through an aperture in the plate; and wherein the boss is deformed to form a riveted connection permanently securing the plate to the rose.

21. A door lock, comprising:

a lock chassis including a housing; and a rose assembly releasably coupled to the housing, the rose assembly including a rose and a plate positioned within the rose and secured to the rose, wherein the plate includes a tab and a plurality of resilient members, wherein the tab is engaged in contacting abutment with the lock chassis, and wherein each of the resilient members is engaged in contacting abutment with the housing of the lock chassis; and wherein relative lateral movement of the plate with the housing aligns the rose assembly with the housing and closing movement of the plate with the housing deflects the resilient member to a position with respect to the housing to resiliently secure the rose to the housing.

22. A door lock, comprising:

a lock chassis including a housing having an outer perimeter; and a rose assembly releasably coupled to the housing, the rose assembly including a rose and a plate positioned within the rose and secured to the rose, wherein the plate includes a ring-shaped annular portion having an inner perimeter and an outer perimeter, and a tab and a resilient member that extend radially outward from the outer perimeter of the annular portion, wherein the tab is engaged in contacting abutment with the outer perimeter of the lock chassis housing, and wherein each of the resilient members is engaged in contacting abutment with the outer perimeter of the lock chassis housing.

23. The door lock of claim 1, wherein each of the tab and the resilient members includes a hooked end portion that extends over the outer perimeter of the lock chassis housing.

* * * * *